United States Patent [19]

Hamilton

[11] 4,090,724

[45] May 23, 1978

[54] TRACTOR-SCRAPER TRANSPORT BRACKET

[75] Inventor: Thomas R. Hamilton, Joliet, Ill.

[73] Assignee: Caterpillar Tractor Co., Peoria, Ill.

[21] Appl. No.: 539,780

[22] Filed: Jan. 9, 1975

Related U.S. Application Data

[62] Division of Ser. No. 438,285, Jan. 31, 1974, Pat. No. 3,893,250.

[51] Int. Cl.[2] ..... B60F 1/14

[52] U.S. Cl. ..... 280/415 R

[58] Field of Search ..... 280/400, 401, 402, 415 R, 280/415 A, 415 B; 37/129, 126 R

[56] References Cited

U.S. PATENT DOCUMENTS

| | | | |
|---|---|---|---|
| 3,015,173 | 2/1962 | Kimsey et al. | 37/129 |
| 3,066,952 | 12/1962 | Price | 280/415 A |
| 3,231,294 | 1/1966 | Horney | 280/415 A |
| 3,840,252 | 10/1974 | Jocoy | 280/415 A |

*Primary Examiner*—John A. Pekar
*Attorney, Agent, or Firm*—Phillips, Moore, Weissenberger, Lempio & Majestic

[57] ABSTRACT

A tractor scraper is rearranged into a transport or drivable condition to have first ends of its draft arms mounted interiorly on the sidewalls of the scraper bowl and the second ends thereof connected to its draft tube by a pair of vertically disposed transport brackets.

5 Claims, 5 Drawing Figures

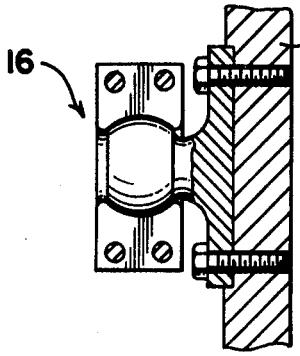
Fig-4-
Fig-3-
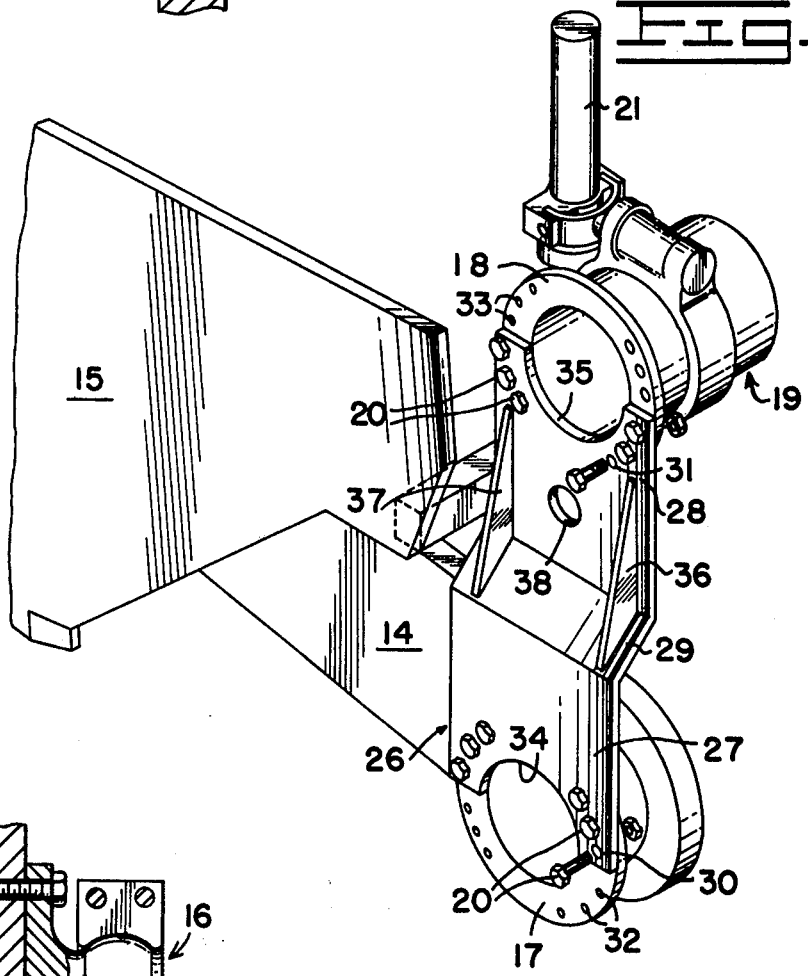
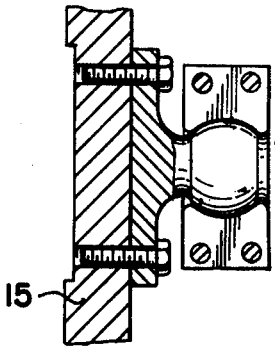
Fig-5-

TRACTOR-SCRAPER TRANSPORT BRACKET

This is a division of Ser. No. 438,285, filed Jan. 31, 1974, now U.S. Pat. No. 3,893,250.

BACKGROUND OF THE INVENTION

Wheel-tractor scrapers pose a shipping problem, such as when they are delivered to a job site or customer on a railroad flat car or are driven on a public highway. In particular, the width and low operating profile of the scrapers require special shipping techniques to comply with certain governmental regulations. For example, U.S. Pat. No. 3,015,173, assigned to the assignee of this application, discloses the detachment and placing of the scraper's draft arms in the scraper bowl to reduce the width thereof for shipping purposes. In addition, such patent discloses the use of a bracket which is secured between a draft tube and apron of the scraper.

SUMMARY OF THIS INVENTION

An object of this invention is to provide an improved, economical and non-complex rigid transport bracket for tractor scrapers and a method for efficiently using the same. The transport bracket is detachably interconnected between one end of each draft arm and the draft tube of the scraper. The opposite ends of the draft arms are preferably mounted interiorly on sidewalls of the scraper bowl. The bracket preferably comprises longitudinally spaced first and second end portions integrally connected together in offset relationship by an intermediate portion. Mounting means, formed at each end of the end portions, are adapted to interconnect the draft arms and the draft tube in the manner mentioned above.

BRIEF DESCRIPTION OF THE DRAWINGS

Other objects of this invention will become apparent from the following description and accompanying drawing wherein:

FIG. 3 is an enlarged isometric view of a transport bracket utilized to maintain the scraper in its FIG. 2 transport condition; and FIGS. 4 and 5 are enlarged sectional views taken in the direction of arrows IV—IV in FIG. 1 and V—V in FIG. 2, respectively.

DETAILED DESCRIPTION

Figure 1:
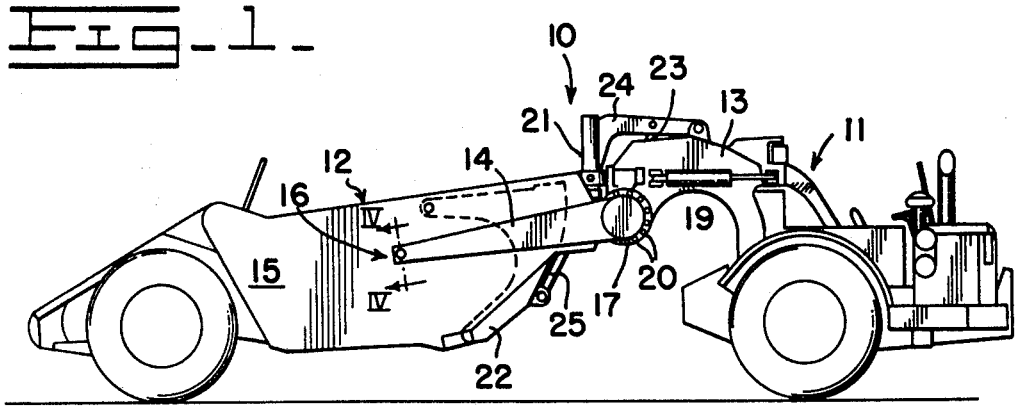
FIG. 1 is a side elevational view of a wheel-tractor scraper shown in its operating condition.

FIG. 1 illustrates a wheel-tractor scraper 10 comprising a two-wheeled tractor 11 connected to a scraper bowl 12 by a gooseneck 13 and a pair of laterally spaced draft arms 14 (one shown). Each draft arm has a first end mounted exteriorly on a sidewall 15 of the scraper bowl by a standard trunnion assembly 16 (FIG. 4). The second end of each draft arm carries an annular flange 17 attached to a like flange 18 (FIG. 3) of a laterally extending draft tube 19 by circumferentially disposed cap screws 20.

The scraper further comprises a pair of lift cylinders 21 (one shown) supported on draft tube 19. The cylinders function in a conventional manner to selectively raise or lower attached scraper bowl 12. A conventional apron 22 is pivotally mounted within the bowl to selectively open or close the front open end thereof by means of a cylinder, partially shown at 23, a lift frame 24 and a link 25.

Figure 2:
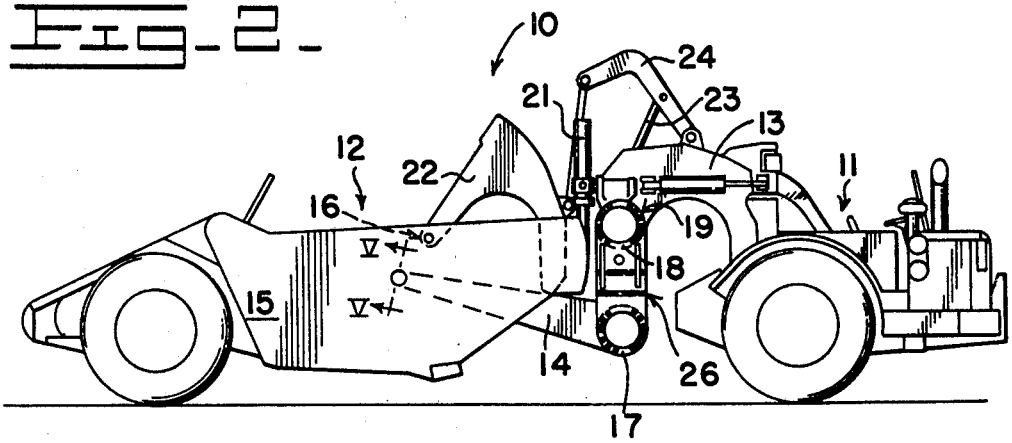
FIG. 2 is a view similar to FIG. 1, but showing the wheel-tractor scraper rearranged in a transport condition.

When it is desired to transport the scraper to a remote location, such as by a railroad flat car or by driving it on a public highway at a relatively high speed (e.g., 30 m.p.h.), workmen will proceed to rearrange the scraper to its FIG. 2 transport condition. Firstly, apron 22 is raised above and later rested upon draft arms 14 which are detached from the scraper bowl and draft tube 19 by releasing trunnion assemblies 16 and cap screws 20. Each draft arm is flopped-over 180 degrees to have its first end remounted interiorly on a respective sidewall 15 by trunnion assembly 16 (FIG. 5).

A second end of each draft arm is connected to a lateral end of draft tube 19 by a vertically disposed transport bracket 26. As more clearly shown in FIG. 3, the transport bracket comprises longitudinally spaced first and second end portions 27 and 28, respectively, integrally connected together in offset relationship by an intermediate portion 29. The first and second end portions of a bracket are substantially disposed in parallel planes each substantially coincident with the faces of flanges 17 and 18, respectively. Each end of the bracket has mounting means formed thereat, such as circumferentially disposed holes 30 and 31 which align with underlying holes 32 and 33, respectively, formed in flanges 17 and 18.

Cap screws 20 can thus be utilized to attach the ends of the bracket to the flanges. Semi-circular cut-outs 34 and 35 may be formed on each end of the bracket to provide guide means, conforming to an inner radius of flanges 17 and 18, to precisely align holes 30 with underlying holes 32 and holes 31 with underlying holes 33. The bracket may further comprise a pair of triangular reinforcing gussets 36 and 37 secured to portions 28 and 29 thereof and a lifting hole 38.

Upon transport of the scraper to its job site or the like, the above procedure may be reversed. In particular, brackets 26 would be removed from the draft arms and draft tube and the draft arms reattached to the scraper as shown in FIG. 1.

What is claimed is:

1. A tractor scraper transport bracket comprising longitudinally spaced first and second end portions integrally connected together in offset relationship by an intermediate portion, and mounting means formed at each of the first and second end portions of said transport bracket for attaching said bracket to an end of a draft arm and to a draft tube of a tractor scraper, each of said mounting means comprising a plurality of holes formed through a respective end portion of said transport bracket and disposed in semi-circular relationship thereon.

2. The transport bracket of claim 1 wherein the first and second end portions of said transport bracket are substantially parallel.

3. The transport bracket of claim 1 further comprising at least one reinforcing gusset secured between the intermediate and second end portions of said transport bracket.

4. The transport bracket of claim 1 further comprising lifting means on the second end portion of said transport bracket.

5. The transport bracket of claim 1 further comprising a semi-circular cut-out formed through each of the first and second end portions of said transport bracket, a respective plurality of said holes being circumferentially disposed about a respective one of said cut-outs.

* * * * *